United States Patent [19]

McDermott

[11] 4,257,322

[45] Mar. 24, 1981

[54] REFUSE COMPACTOR

[75] Inventor: Robert H. McDermott, Chorley, England

[73] Assignee: Solid Waste Engineering Limited, Bolten, England

[21] Appl. No.: 52,470

[22] Filed: Jun. 27, 1979

[30] Foreign Application Priority Data

Jun. 28, 1978 [GB] United Kingdom ..... 29051/78

[51] Int. Cl.[3] ..... B30B 7/00

[52] U.S. Cl. ..... 100/229 A; 100/233; 100/295

[58] Field of Search ..... 100/229 A, 233, 295; 53/527

[56] References Cited

U.S. PATENT DOCUMENTS

| | | | |
|---|---|---|---|
| 3,129,657 | 4/1964 | Farley | 100/229 A |
| 3,229,618 | 1/1966 | O'Connor | 100/229 A |
| 3,511,176 | 5/1970 | Szaj | 100/229 A |
| 3,554,120 | 1/1971 | Liberman | 100/229 A |
| 3,625,140 | 12/1971 | Glanz | 100/229 A |
| 3,880,072 | 4/1975 | Ord | 100/229 A |
| 3,881,407 | 5/1975 | Goar | 100/229 A |

FOREIGN PATENT DOCUMENTS

| | | | |
|---|---|---|---|
| 1226908 | 3/1971 | United Kingdom | 100/233 |
| 1240584 | 7/1971 | United Kingdom | 100/233 |
| 1409128 | 10/1975 | United Kingdom | 100/233 |

*Primary Examiner*—Billy J. Wilhite

*Attorney, Agent, or Firm*—Birch, Stewart, Kolasch & Birch

[57] ABSTRACT

A refuse compactor comprises a container for the receipt of refuse and a compactor unit which inserts refuse into the container and compact the refuse and seeks to overcome the disadvantage of previously proposed compactors regarding the closure of a full container. For this purpose the container of the refuse compactor includes a pivoted door which is releaseably connected to an actuator of the compactor unit and which is moved by the actuator to perform the refuse insertion and compaction operations. Once the container is full, the door is released from the actuator and locked to the remainder of the container to close the full container. The compactor can handle a wide variety of commercial and industrial refuse.

9 Claims, 7 Drawing Figures

REFUSE COMPACTOR

A previously proposed refuse compactor comprises a refuse container open at one end for the receipt of refuse and a compactor unit for inserting refuse into and compacting refuse in the container. When the refuse container of this previous proposal has been filled, it is removed from the compactor unit for emptying with the open end remaining open.

It is a disadvantage of this previous proposal that refuse can spill from the open end during transport of the refuse container for emptying. It is an object of the invention to mitigate this disadvantage.

According to the invention, there is provided a refuse compactor comprising a refuse container open at one end for the receipt of refuse, a container door hinged on the container for pivotal movement between an open position for the insertion of refuse and a closed position in which the container door closes the open end of the container and compacts refuse in the container, and a compactor unit connected to the container and comprising drive means connected to the container door for moving the container door between the open and closed positions, the drive means being releaseable from the container door and the container door being lockable to the container in the closed position to allow removal of a full closed container from the compactor unit.

The invention overcomes the above mentioned disadvantage because the locked door retains the refuse in the container during transport.

Figure 1:
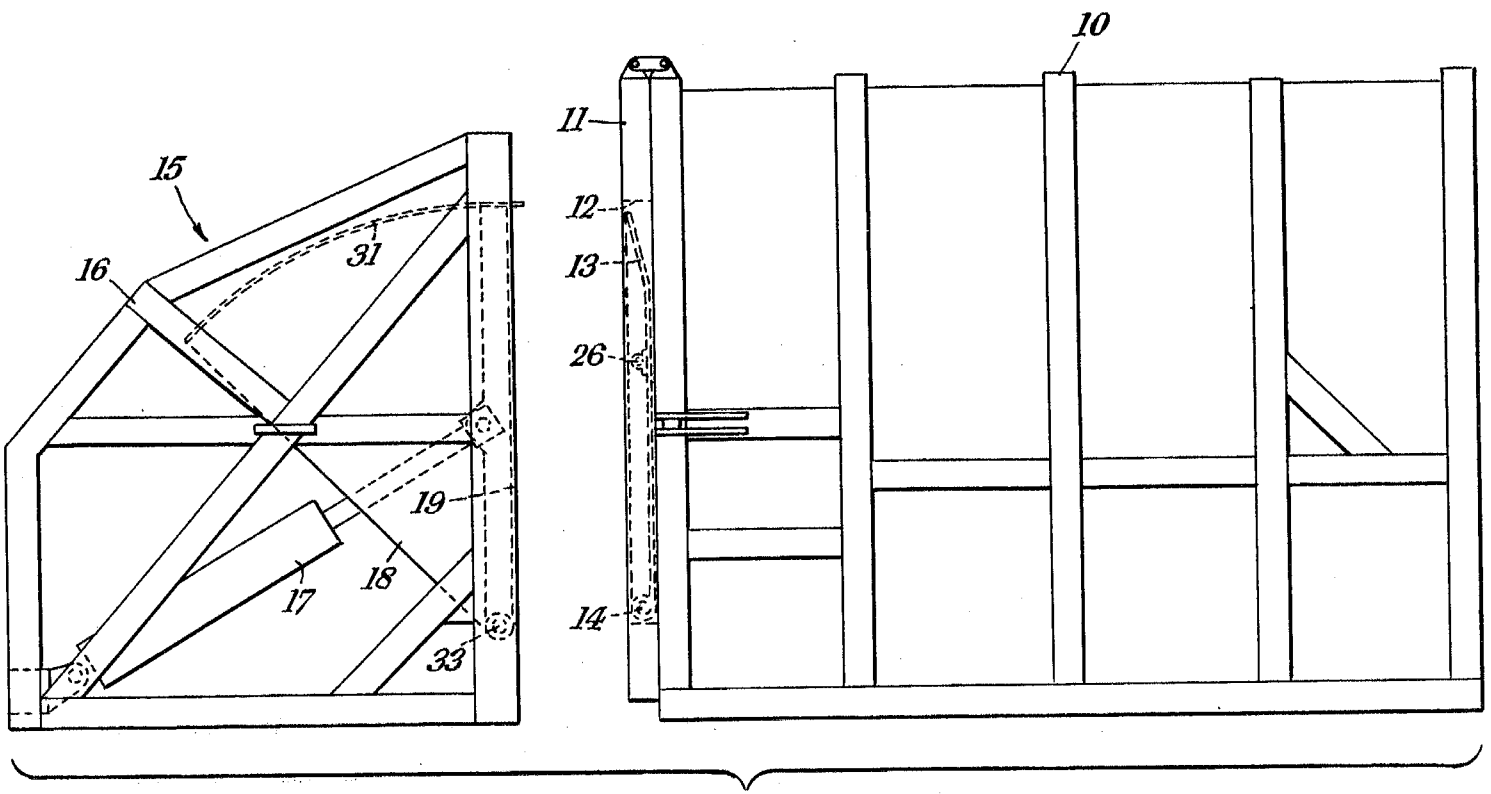
Figure 2:
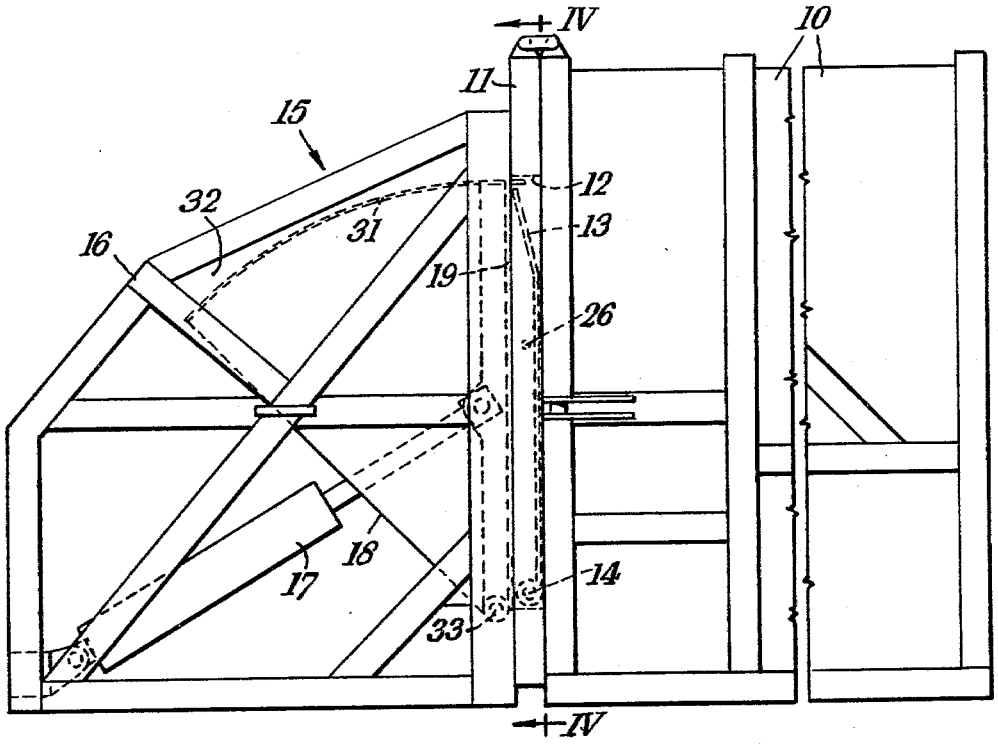
Figure 3:
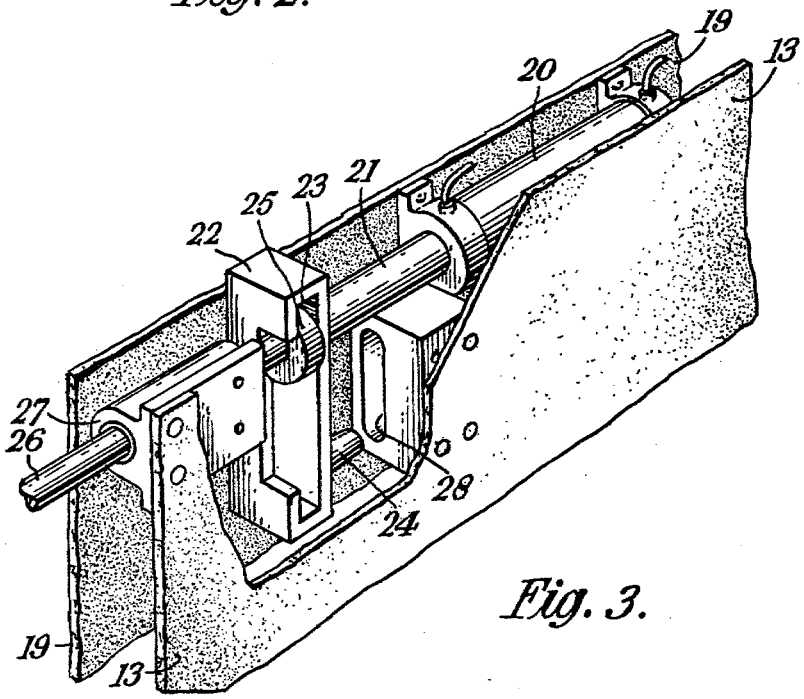
Figure 4:
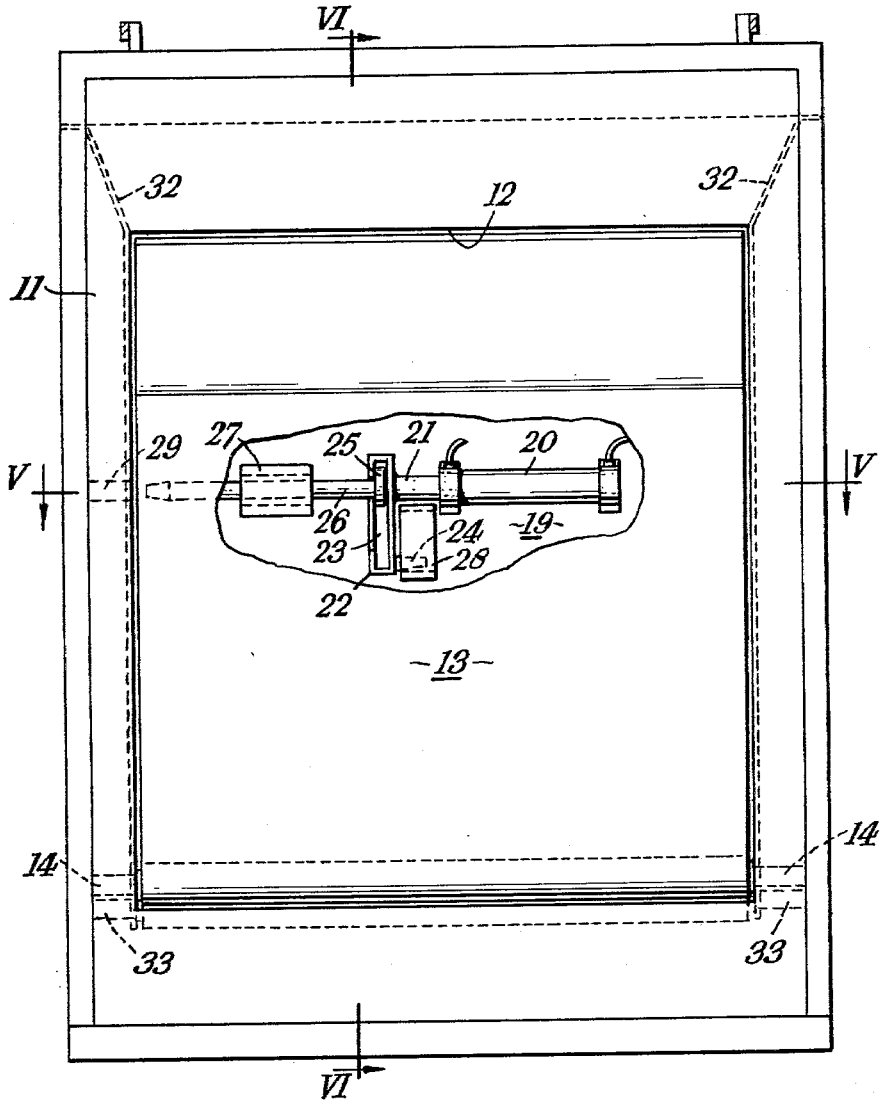
Figure 5:
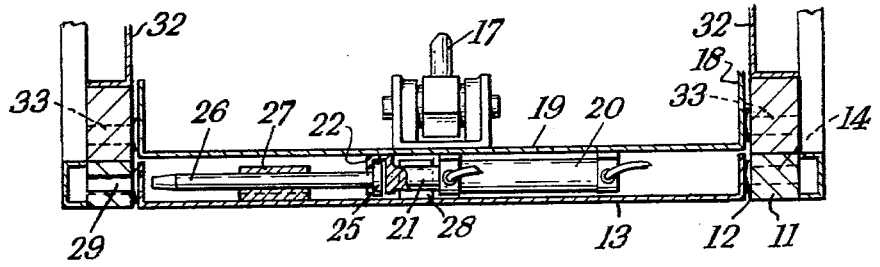
Figure 6:
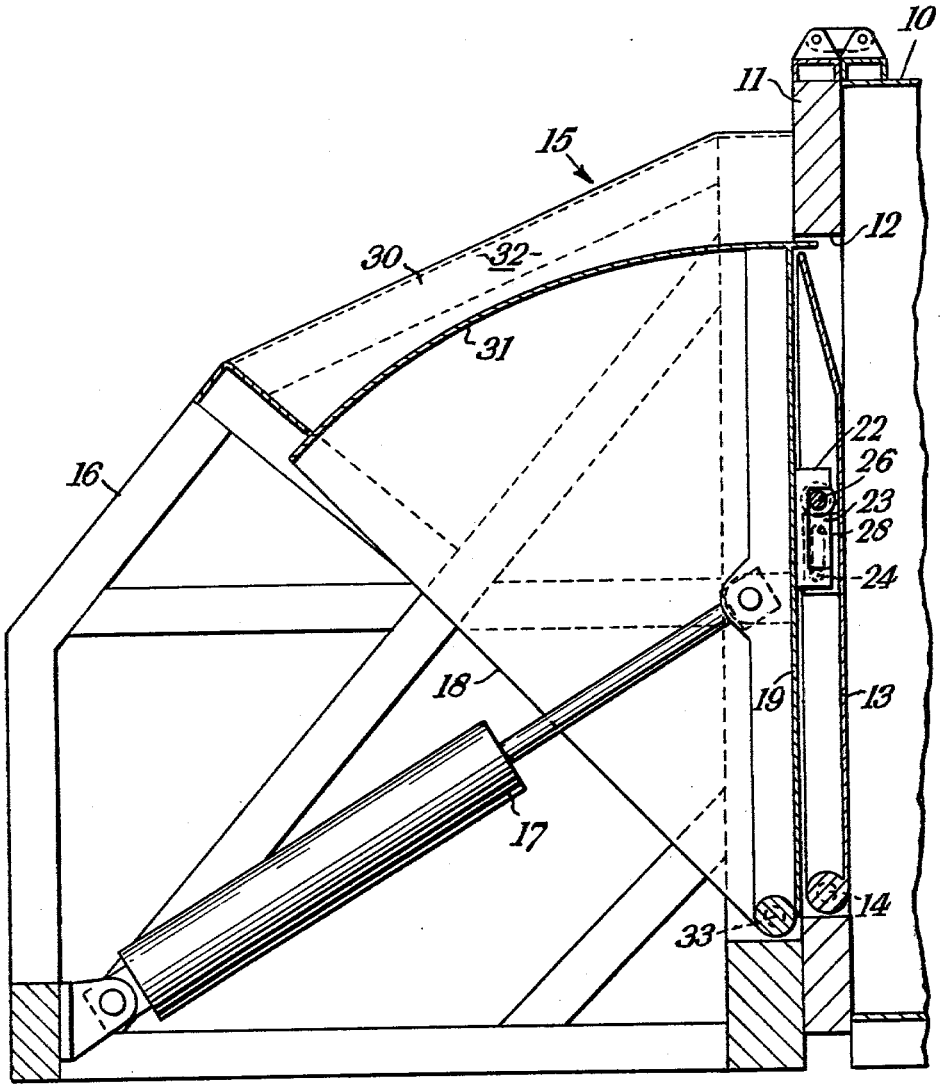
Figure 7:
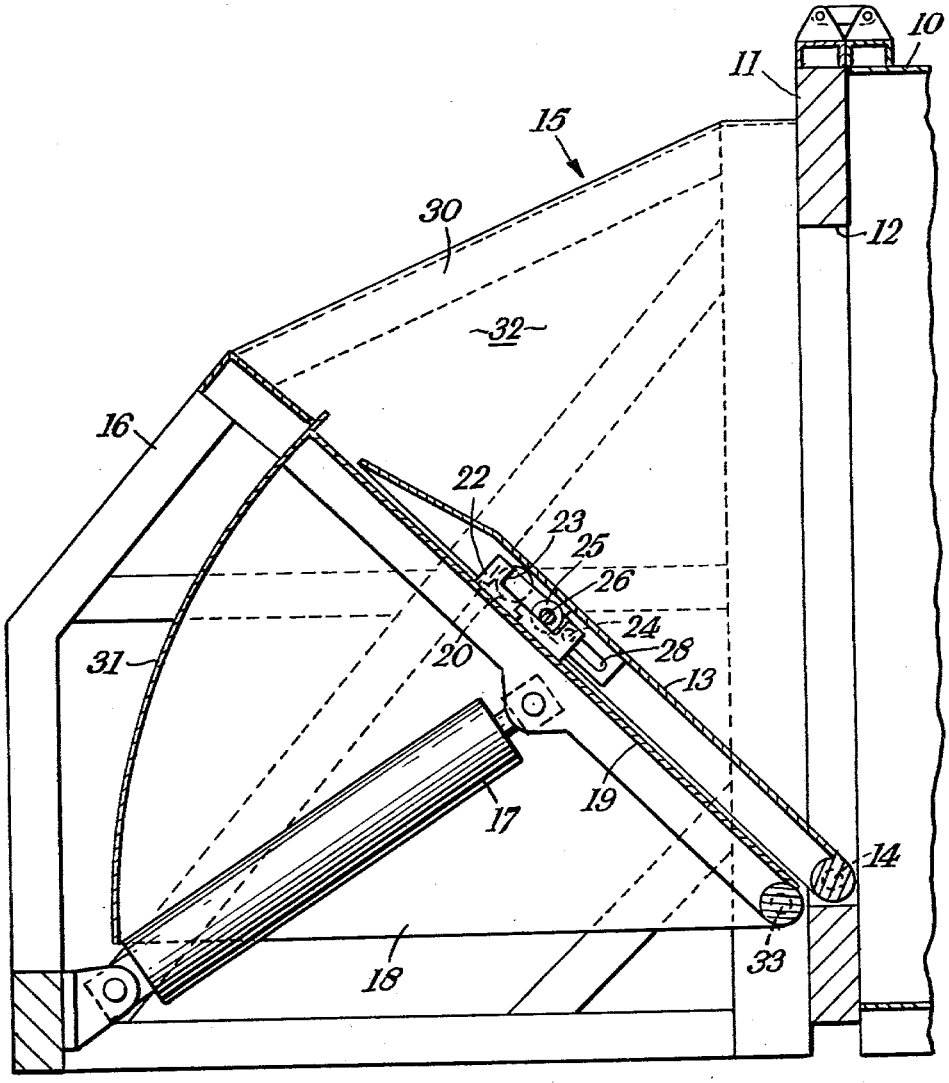

The following is a more detailed description of one embodiment of the invention, by way of example, reference being made to the accompanying drawings in which:

FIG. 1 is a side elevation of a refuse compactor showing a container separated from a compactor unit, FIG. 2 is a side elevation of the refuse compactor of FIG. 1 but showing only a part of the container and showing the container and the compactor unit connected, FIG. 3 is a partial perspective view of a plate of the compactor unit and a door of the container, partially broken-away to show a door-locking drive-releasing mechanism, FIG. 4 is a section on the line IV—IV of FIG. 2, partially broken-away to show the mechanism of FIG. 3, FIG. 5 is a section on the line V—V of FIG. 4, FIG. 6 is a section on the line VI—VI of FIG. 4, FIG. 7 is a similar view to FIG. 6 but with the plate and the door in an open position.

Referring first to FIG. 1, the refuse compactor comprises a generally square or rectangular cross-section refuse container 10 having an open end which is closed by a pivoted end closure 11. The end closure 11 is provided with a rectangular opening 12 and a container door 13 is connected at a lower edge to the container end closure 11 by pivots 14 for movement about a horizontal axis between an open position (FIG. 7) and a closed position (FIGS. 1, 2, 4, 5 and 6) in which it closes the opening 12.

A compactor unit 15 is, in the position shown in FIGS. 2 to 7, connected to the open end of the container and comprises a support structure 16 on which is mounted a hydraulic ram 17 which is connected between the support structure 16 and a main ram wedge 18 which is mounted on the support structure 16 for pivotal movement about a horizontal axis 33 parallel to but spaced from the axis of the container door pivots 14. The main ram wedge 18 includes a front plate 19 which, in the position shown in FIG. 2, is parallel to but spaced from the container door 13. The main ram wedge 18 also includes an arcuate shield 31 extending rearwardly therefrom, as best seen in FIGS. 6 and 7, for a purpose to be described below.

The front plate 19 carries a door-unlocking drive-release mechanism (see FIGS. 3, 4 and 5) which includes a double acting hydraulic ram 20 whose movable piston 21 is connected to an operating device 22, best seen in FIG. 3. The operating device 22 comprises an elongate slot 23 and a projecting pin 24. As best seen in FIG. 3, in the position shown in this Figure, the slot engages behind the head 25 of a bolt 26 which is slidable in a bush 27 (see FIG. 5) and the pin 24 engages in an elongated hole 28 formed in a block carried on the container door 13. The block may be removable from the door. In the position shown in FIG. 5, the bolt 26 is retracted from engagement with a hole 29 formed in the container end closure 11 and the pin 24 and the hole 28 form a latch which connects the compactor unit hydraulic ram 17 to the container door 13.

The compactor unit 15 is provided with a refuse inlet 30 in an upper surface thereof which gives access to a rectangular section hopper which, as seen in FIG. 7, has one end wall defined by the open end closure 11, side walls defined by side walls 32 of the compactor unit, and the other end wall defined by the container door 13 when opened as shown in FIG. 7.

In use, with the compactor unit 15 and door 13 in the positions shown in FIGS. 2 and 6 the ram 17 is actuated to pivot the container door 13 to the open position shown in FIG. 7. The length of the slot 23 and of the elongated hole 28 are such as to accommodate the relative movement between these parts and the bolt head 25 and the pin 24 respectively caused by the spacing of the pivot axis of the door 13 and the plate 19, as seen in FIGS. 6 and 7. In this open position, refuse can be tipped through the refuse inlet 30 into the hopper where it rests on the door and in the opening of the refuse container 10 for insertion into the container. Upon reverse movement of the drive ram 17, the container door 13 is returned to the closed position to insert refuse into the container 10 and to compact refuse within the container 10. Relative movement between the plate 19 and the container door 13 is once again accommodated by movement of the bolt head 25 along the slot 23 device and by movement of the pin 24 along the hole 28. The shield 31, in this closed position and as shown in FIG. 6, closes the refuse inlet 30 to prevent further refuse being placed in the hopper. This cycle is repeated until the container 10 is filled with refuse.

The double acting hydraulic ram 20 is then operated and its piston rod extends to move the operating device 22. By this movement, the operating device 22 pushes the bolt 26 into the hole 29 in the container end closure 11 to lock the container door 13 to the container 10 in the closed position. Simultaneously, the pin 24 is released from engagement with the hole 28 to unlatch the drive ram 17 from the container door 13, see FIG. 3. The compactor unit is disconnected from the container to allow the full closed container 10 to be removed for emptying without spillage of refuse as shown in FIG. 1.

An empty container 10 can then be aligned with the compactor unit so that its door 13 is parallel to but spaced from the ram wedge plate 19. The container and the compactor unit can then be connected together. In this position, the operating device 22 engages behind the bolt head 25 which is inserted in the hole 29. The double acting ram 20 can then be retracted to retract the bolt 26 from the hole 29 and to insert the pin 24 into the hole 28. Thus, the container door 13 is unlocked for pivotal movement and is latched to the hydraulic ram 17.

The filling cycle can then re-commence as described above with reference to the drawings.

The compactor will normally be clamped to the container by manually operated clamps. Alternatively, clamps may be provided which clamp the two parts together automatically as they are brought together. It will be appreciated however that the refuse container 10 and the compactor unit need not be connected by such clamps in order to prevent movement of the refuse container 10 on operation of the ram, the latching engagement between this ram and the container door 13 could be so designed as to provide the sole means of connection between the compactor unit and the container. It will also be appreciated that the provision of the ram operated locking and release mechanism obviates the likelihood of injury to an operative during these operations, as might occur were the locking and release performed manually.

I claim:

1. A refuse compactor comprising a refuse container open at one end for the receipt of refuse, a container door hinged on the container for pivotal movement between an open position for the insertion of refuse and a closed position in which the container door closes the open end of the container and compacts refuse in the container, a compactor unit releasably connected to the container and comprising drive means connected to the container door for moving the container door between the open and closed positions, and a door-locking drive-releasing mechanism which operates automatically to simultaneously lock the container door to the container in the closed position and release the drive means from the container door.

2. A refuse compactor according to claim 1 wherein the door-locking drive-releasing mechanism comprises an actuator which on operation in one sense locks the container door and releases the drive means and on operation in an opposite sense unlocks the container door and connects the drive means.

3. A refuse compactor according to claim 2 wherein the actuator comprises a double acting hydraulic ram acting on at least one bolt and a latch, operation of said ram in one sense pushing the said bolt into locking engagement with the container and releasing the latch to disengage the drive means, operation of the ram in the opposite sense retracting said bolt from locking engagement with the container and engaging the latch to connect the drive means.

4. A refuse compactor according to claim 3 wherein the ram is mounted on a part of the drive means adjacent the container door and wherein the mechanism further includes an operating device which is connected to the ram for movement thereby and which has a slot which so faces the container door and which so engages with said bolt as to transmit movement of the ram to said bolt and to allow automatic disengagement of the slot from said bolt on removal from the compactor unit of a full container.

5. A refuse compactor according to claim 4 wherein the operating device includes a pin which forms the latch and which so engages in a hole in the container door on operation of said ram in said other sense as to connect the drive means to the container door and which so disengages from said hole on operation of said ram in said one sense as to disengage the drive means.

6. A refuse compactor according to claim 4 wherein the drive means includes a plate which, when the container and the compactor unit are connected, is closely adjacent the container door and lies in a plane and is pivotable about an axis parallel to the plane and the pivotal axis of the container door respectively, the plate forming the part of the compactor on which the ram is mounted, and the slot and the hole on the container door for the pin being arranged to allow relative planar movement between the plate and the container door.

7. A refuse compactor according to claim 1 wherein the drive means comprises a hydraulic ram.

8. A refuse compactor according to claim 1 and provided with a hopper having one end wall defined by the open end of the container, side walls defined by side walls of the compactor unit and the other end wall defined by the container door, when in the open position, and a refuse inlet provided in an upper surface of the compactor unit giving access to the hopper.

9. A refuse compactor according to claim 1 wherein the container door is hinged on an end closure of the container, the end closure being operable to allow removal of the contents of the container.

* * * * *